United States Patent [19]

Ramer

[11] 3,953,930

[45] May 4, 1976

[54] SKI BOOT WITH FLEXIBLE TOE

[75] Inventor: Paul C. Ramer, Denver, Colo.

[73] Assignee: Alpine Research, Inc., Golden, Colo.

[22] Filed: Mar. 19, 1975

[21] Appl. No.: 559,783

[52] U.S. Cl. ..... 36/94; 36/117

[51] Int. Cl.[2] ..... A43B 00/00

[58] Field of Search ..... 36/2.5 R, 2.5 AL

[56] References Cited

UNITED STATES PATENTS 3,728,804 4/1973 Mochizuki ..... 36/2.5 AL 3,844,055 10/1974 Koyama et al. ..... 36/2.5 AL

*Primary Examiner*—Patrick D. Lawson

*Attorney, Agent, or Firm*—Burton, Crandell & Polumbus

[57] ABSTRACT

A ski boot made of a rigid shell having a flexible sole thereon includes a toe member which is telescopically related to a rear member at a location corresponding to the ball of a user's foot so that the shell will flex during walking movements but can be retained in a rigid condition for skiing.

9 Claims, 3 Drawing Figures

SKI BOOT WITH FLEXIBLE TOE

BACKGROUND OF THE INVENTION

Ski boots have evolved from having a leather upper portion to having very stiff plastic upper portions with the object being to immobilize the ankle during use for better control of the skis. The stiff plastic boots, however, have proven to be extremely uncomfortable and are difficult to walk in due to the inflexible nature of the upper portion and the sole.

Attempts have been made at making ski boots more comfortable and rendering them more suitable for walking while retaining the desired rigidity for skiing. An example of such a boot is disclosed in application Ser. No. 505,632 for "SKI BOOT" which is of common ownership with the subject application.

OBJECTS OF THE INVENTION

It is an object of the present invention to provide a new and improved article of footwear having a toe portion which is at least partially separated and flexibly interconnected to the remainder of the article to facilitate walking motion for a user of the article.

It is another object of the present invention to provide a new and improved article of footwear wherein the upper portion of the article is made of a rigid material composed of a rear member and a toe member with the toe member being flexibly interconnected to the rear member to facilitate walking movement.

It is another object of the present invention to provide a new and improved ski boot having a rigid upper and a flexible sole connected to the upper with the upper having separate toe and rear members flexibly interconnected at a location corresponding to the ball of a user's foot.

It is another object of the present invention to provide a new and improved ski boot having an upper made of a rigid material connected to a flexible sole, with the upper having toe and rear members which are telescopically related at a location corresponding to the ball of a user's foot to allow the sole of the boot to flex with the normal walking motion of a user of the boot.

SUMMARY OF THE INVENTION

The article of footwear of the present invention includes an upper section having a flexible sole connected thereto with the upper section being divided into a toe member and a rear member each made of a substantially rigid material and being operably interrelated at a location corresponding to the ball of a user's foot to allow the boot to flex during walking motion.

More particularly, the toe member of the upper is enlarged relative to the rear member at a location corresponding to the ball of a user's foot and slidably receives the rear member at that location to allow the sole of the boot to flex during normal walking motion. When the sole flexes, the rear member slides in a telescopic manner within the toe member.

To prevent hyperextension, or a reverse flexing of the sole, such as might occur when the ski boot is attached to a ski, stop means are provided to interconnect the toe and rear members and limit the movement of the toe member forwardly away from the rear member while allowing rearward movement of the toe member relative to the rear member.

Other objects, advantages and capabilities of the present invention will become more apparent as the description proceeds taken in conjunction with the accompanying drawings.

DESCRIPTION OF THE PREFERRED EMBODIMENT

Figure 1:
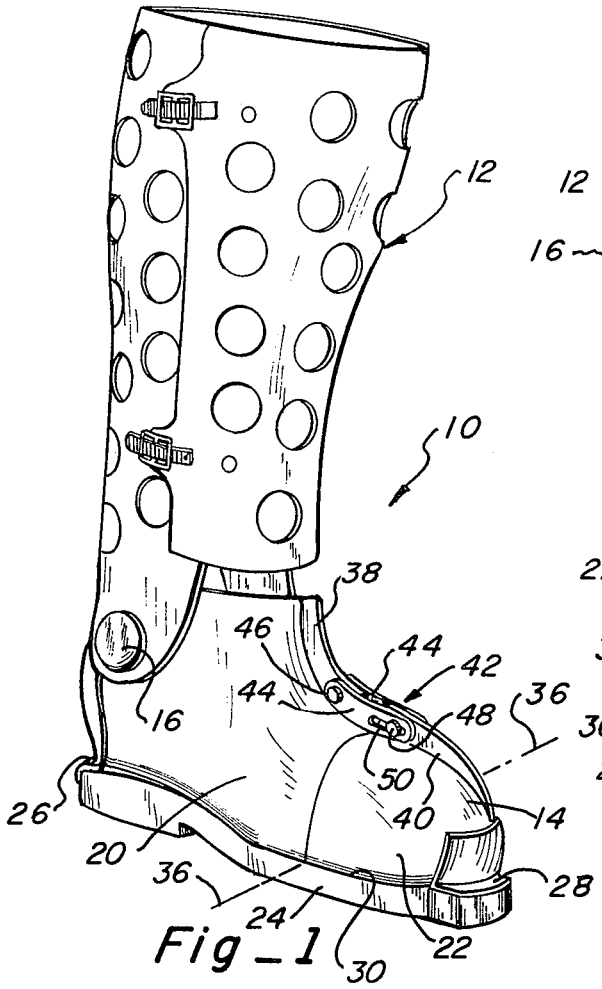
FIG. 1 is a perspective view of a boot utilizing the present invention.
Figure 2:
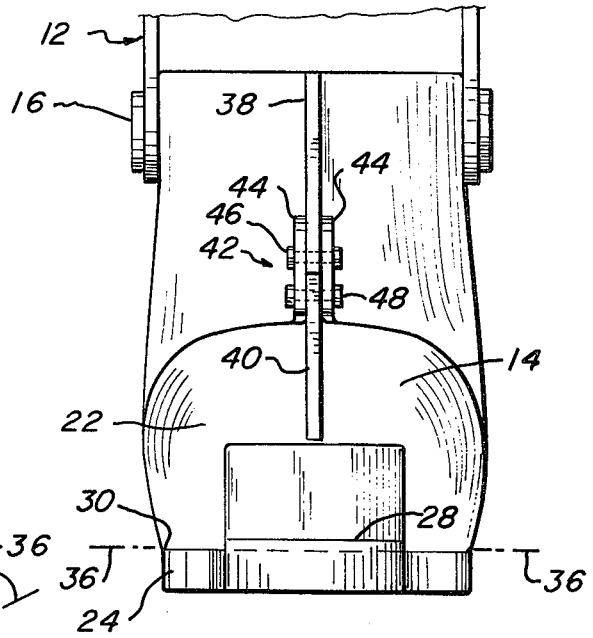
FIG. 2 is a fragmentary front elevation of the boot of FIG. 1.
Figure 3:
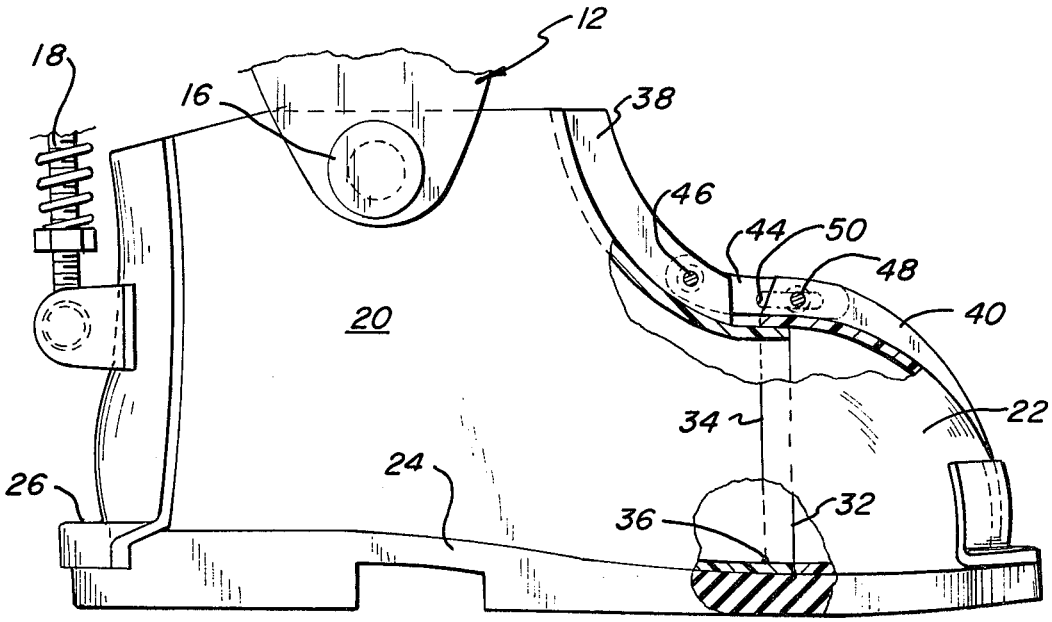
FIG. 3 is a fragmentary side elevation of the boot of FIG. 1 with parts broken away.

Referring first to FIG. 1, a ski boot 10 incorporating the present invention is shown. The ski boot is of the general type disclosed in the aforementioned patent application, Ser. No. 505,632 for "SKI BOOT" which is of common ownership with the subject application. The boot 10 includes a leg section 12 adapted to extend around the calf of the user's leg, a foot portion 14, hereinafter referred to as the upper, adapted to receive a user's foot, pivot means 16 interconnecting the leg portion with the upper and a spring connector 18 adapted to control pivotal movement of the leg portion relative to the upper.

The upper 14 or foot portion of the boot has a rear member 20 and a toe member 22 which are mounted upon a flexible sole 24 to define a pocket taking the general configuration of a foot. The heel of the rear member 20 has an enlarged shoulder 26 formed thereon adapted to cooperate with conventional ski bindings (not shown) in holding the heel of the boot tightly against a ski. Similarly, the leading end of the toe member 22 is provided with a shoulder 28 adapted to cooperate with conventional ski bindings in holding the toe of the boot tightly against a ski.

Both the rear member 20 and toe member 22 are affixed to the top surface 30 of the flexible sole 24, which may be made of rubber or the like, by an adhesive fastener or the like, not seen. As best appreciated in FIG. , the toe member is a hollow rearwardly opening shell, preferably of a substantially inflexible or rigid plastic material, which is rounded to comfortably receive the toes of a user's foot. The rear member is similarly hollow and made of a substantially inflexible or rigid material such as plastic and is adapted to comfortably receive the portion of a user's foot which is rearwardly of the ball of the foot.

The leading end 32 of the rear member 20 has a cross-sectional configuration substantially indentical to the cross-sectional configuration of the trailing end 34 of the toe member 22 but is slightly smaller than the trailing end 34 of the toe member so as to slidably fit into the toe member in a telescopic manner. The different cross-sectional sizes of the toe and rear members, at the overlapping location corresponding to the ball of the foot, is preferably fairly tight so as to prevent the ingress of snow, water and the like into the boot but is loose enough so that the sole 24 of the boot is free to flex causing the rear member to slide within the toe member. If desired, a sliding seal (not shown) could be inserted between the toe and rear members at the overlapping location to assure that snow, water and the like is kept out of the boot. As will be appreciated, since the toe member is physically separate from the rear member, even though both are affixed to the sole, the toe member can pivot about an axis 36 extending transversly of the boot along the lower rearwardmost edge of the toe member where it is connected to the sole so that the toe member can actually roll upwardly and rearwardly as the sole of the boot is flexed during normal walking motion.

The boot 10 illustrated includes a raised flange 38 centered along the front of the rear member 20 and a continuation of that flange 40 centered along the top of the toe member 22. The flanges 38 and 40 on the rear and toe members respectively are separated at the overlapping location so that the toe member is free to move rearwardly over the rear member as during walking motion without the flanges abutting and preventing such movement.

Even though the boot is not likely to be hyperextended, or in other words for the toe of the boot to be flexed downwardly relative to the rear portion of the boot, without means for preventing such, it is possible that hyperextension could take place when the boot is affixed to a ski with the binding tightly retaining the toe and heel of the boot against the ski. To prevent hyperextension, stop means 42 are provided, in the disclosed embodiment being in the form of a pair of rigid straps 44 extending along opposite sides of the flanges 38 and 40 of the rear and toe members respectively. The straps 44 are identical and are each anchored to the flange 38 on the rear member as by a rivet 46 and are slidably attached to the flange 40 on the toe member by a rivet 48 extending through the flange 40 and through an elongated slotted opening 50 provided in each strap near the leading end of the strap. As will be appreciated, the straps allow the toe member to move rearwardly relative to the rear member as during normal walking motion but limit the forward movement of the toe member relative to the rear member beyond a position wherein the sole of the boot is substantially flat. Further movement of the toe member beyond this position is prevented when the rivet 48 on the toe member engages the rearward most extent of the slotted openings 50 in the straps.

It will be appreciated from the foregoing description that a ski boot has been described which permits the user of the boot to walk in a substantially normal fashion by allowing the toe of the boot to roll rearwardly relative to tthe rear portion of the boot. This of course renders the boot much more comfortable for its user and yet does not sacrifice the rigid characteristics of the boot which have been found to be important for immobilizing the ankle during skiing activities. It should be noted that when the boot is affixed to a ski, with the toe and heel portion of the boot tightly retained against the ski, the toe cannot roll upwardly relative to the heel nor can the ball portion of the foot be raised, hyperextending the sole, due to the stop straps interconnecting the toe and rear members of the boot. Accordingly, during skiing activities, the invention allows the boot to function as though the telescoped toe and rear members did not exist, but during normal walking movement, the boot substantially allows the natural movement of the foot rendering such motion easier and more accommodating to the user of the boot.

Although the present invention has been described with a certain degree of particularity, it is understood that the present disclosure has been made by way of example and that changes in details of structure may be made without departing from the spirit thereof.

What is claimed is:

1. An article of footwear comprising in combination:

a sole, and an upper, the upper having the sole attached thereto and defining a pocket into which a user's foot is adapted to be received, said upper including a toe member and a rear member, said toe and rear members being at least partially separated and operatively telescopic to allow relative movement.

2. The article of claim 1 wherein said rear member is slidably received in at least a portion of said toe member.

3. The article of claim 1 further including stop means for limiting movement of the toe member away from the rear member.

4. The article of claim 1 wherein said sole is flexible and wherein said upper is made of a substantially inflexible material, said toe and rear members being separate from each other.

5. The article of claim 4 wherein said rear member slidably protrudes forwardly into said toe member.

6. The article of claim 5 further including stop means for limiting movement of the toe member forwardly away from the rear member.

7. The article of claim 5 wherein the location at which the rear member protrudes into the toe member corresponds to the ball of a user's foot.

8. A ski boot comprising in combination:

a sole, and an upper made of a substantially inflexible plastic material, the upper having the sole attached thereto and defining a pocket into which a user's foot is adapted to be received, said upper including a toe member and a rear member, said rear member slidably protruding forwardly into the toe member at a location corresponding to the ball of a user's foot and a stop member interconnecting the toe and rear members along upper surfaces thereof and adapted to limit forward movement of the toe member away from the rear member.

9. The ski boot of claim 8 wherein said sole is made of a flexible material.

* * * * *